United States Patent [19]

Laser

[11] 4,210,954

[45] Jul. 1, 1980

[54] REFLECTORS

[76] Inventor: Max Laser, Tunnelgatan 20B, Stockholm, Sweden

[21] Appl. No.: 908,527

[22] Filed: May 22, 1978

[30] Foreign Application Priority Data

Jan. 30, 1978 [SE] Sweden ..... 7801054

[51] Int. Cl.[2] ..... F21V 7/00; F21V 17/04

[52] U.S. Cl. ..... 362/303; 362/306; 362/346; 362/444

[58] Field of Search ..... 362/298, 303, 304, 305, 362/306, 310, 341, 346, 353, 359, 360, 377, 444

[56] References Cited

U.S. PATENT DOCUMENTS

| | | | |
|---|---|---|---|
| 1,290,482 | 1/1919 | Bailey | 362/377 |
| 1,809,878 | 6/1931 | Whitman | 362/444 |
| 2,126,650 | 8/1938 | Matera | 362/444 |
| 3,511,985 | 5/1970 | Muscovitch | 362/303 |
| 4,135,232 | 1/1979 | Berkenhoff | 362/306 |

FOREIGN PATENT DOCUMENTS

| | | | |
|---|---|---|---|
| 1267633 | 5/1968 | Fed. Rep. of Germany | 362/444 |

*Primary Examiner*—Samuel W. Engle

*Assistant Examiner*—Donald P. Walsh

*Attorney, Agent, or Firm*—Holman & Stern

[57] ABSTRACT

The invention relates to an improvement in reflectors including a first reflector, which is detachably fastened to a bulb and is combined with a small reflector, which is fixed in front of the bulb and opposite said first reflector in order to reflect direct beams from the bulb to said first reflector, which has a center hole, through which the neck of the bulb is inserted, the edge of said hole being placed against the lower part of the bulb and small reflector being placed on to the upper spherical part of the bulb, whereby said reflector and said small reflector are positioned in relation to each other in a certain optical position in relation to the center of the light of the bulb independently of how far into the socket the bulb is placed, said small reflector having the form of a paraboloid, the focal plane of which is placed so close to the vertex of the paraboloid, that the light beams emitted from the center of the lamp and reflected by said small reflector in the direction towards the lamp, will be directed outside a circle plane, which is formed by a section through the bulb at the area where the bulb is fastened in to the socket.

3 Claims, 2 Drawing Figures

REFLECTORS

The invention relates to an improvement in reflectors including a first reflector, which is detachably fastened to a bulb and is combined with a small reflector. The small reflector is fixed in front of the bulb and opposite the first reflector in order to reflect direct beams from the bulb to the first reflector, which has a center hole. The neck of the bulb is inserted through the center hole with the edge of the hole being placed against the lower part of the bulb and small reflector being placed on to the upper spherical part of the bulb. The large reflector and the small reflector are positioned in relation to each other in a certain optical position in relation to the center of the light of the bulb independently of how far into the socket the bulb is placed.

It has been shown that a large amount of light is reflected from the small reflector back to the bulb and into the cylindrical part of the bulb where the bulb is inserted in the socket. This light will heat the bulb in this area and there is a risk that this heating will cause the mounting of the bulb to loosen from the bulb. This is a serious drawback for this known prior art method of arranging two reflectors. The possibility of using this arrangement has been limited even though this arrangement increases the useful light emitted from the bulb. The object of this invention is to eliminate any light beams to be reflected in the area of the bulb where the mounting of the bulb is arranged. The invention is characterized in that the small reflector has the form of a paraboloid, the focal plane of which is placed so close to the vertex of the paraboloid, that the light beams emitted from the center of the lamp and reflected by the small reflector in the direction towards the lamp, will be directed outside a circle plane, which is formed by a section through the bulb at the area where the bulb is fastened in to the socket. According to a second embodiment of the invention the beams are reflected so that they will meet the first reflector outside the center hole of the reflector. Hereby all the beams reflected by the small reflector are reflected from the first reflector and hereby the emitted light energy from the bulb is increased.

The invention will be described in the following with reference to the accompanying drawings.

Figure 1:
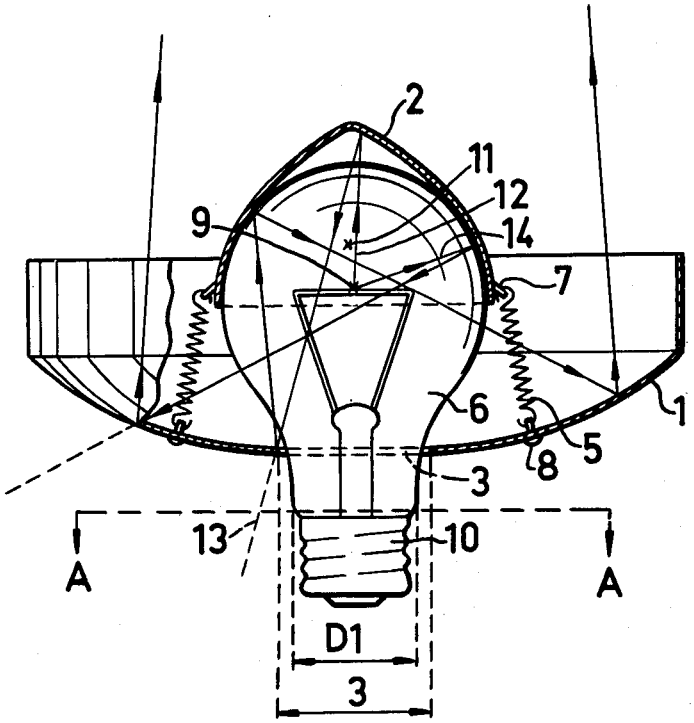

FIG. 1 hereby shows a section through two reflectors and a bulb in accordance with the present invention.

Figure 2:
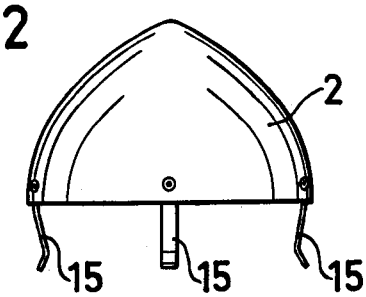

FIG. 2 shows another embodiment of the small reflector.

The embodiment shown in FIG. 1 consists of a large reflector 1, hereinafter called the main reflector, which has a reflecting material on its concave side so that light beams directed to the concave reflecting side will be reflected ahead mainly in parallel with the longitudinal center line of the bulb. The main reflector has a hole 3, through which the fitting part of the bulb can pass. Eyes 8 are fastened to the concave side of the reflector and springs 5 are fixed to the eyes and to a small reflector 2, which has the reflecting material on the concave side. The form of the small reflector is partly adapted to the top part of the bulb 6. The small reflector 2 has ears 7, in which the springs 5 are fixed. By passing the fitting end of the bulb 6 through the hole 3 of the main reflector and placing the small reflector 2 on the top part of the bulb and joining the two reflectors with the springs 5, the bulb will have a fixed position in relation to the two reflectors, whereby the light center of the bulb will be placed in such a position that all light beams which are directed towards the top part of the bulb will be reflected to the main reflector by the small reflector 2. The light beams will then be reflected by the main reflector 1 in a direction, which mainly is parallel with the longitudinal center line of the bulb. Thus, the light emitted from the bulb will be concentrated and directed in one direction.

In order to avoid the small reflector 2 reflecting light beams from the center of the bulb down into the bulb and specially into the mounting area 10 of the bulb, said small reflector 2 has been given a parabolic form. In FIG. 2 there are shown two light beams emitted from the light center 9. In order to simplify the Figure, only two beams have been drawn passing through the upper right quadrant of the bulb. The focus of the paraboloid is designated with 11 and all light beams, which are emitted from the focus are reflected by the small reflector parallel with the longitudinal center line of the reflector. This means, that centrally directed light beams from the focus would be reflected to the fitting area 10 of the bulb and this would also be the situation if the small reflector had a spherical form. According to the inventive idea, however, the small reflector 2 has been so placed in relation to the light center 9 of the bulb, that according to FIG. 1 the light center 9 is situated under the focus 11 and to such an extent, that beams emitted from the light center 9 and passing close to the longitudinal center line of the bulb, are reflected by the small reflector 2 with a direction so that said beams will pass outside a circle plane, which is formed by a section through the fitting area 10 of the bulb. This section is taken along the line A-A and the diameter of that section is D1. As can be seen from FIG. 1 the light beam 12 from the center of the bulb is reflected by the small reflector 2 and it is then reflected by the main reflector 1. However, it can be seen that the optical extension 13 will pass well outside the circle of the diameter D1.

It can also be seen from FIG. 1 that a second light beam 14, which meets the small reflector 2 far away from its vertex, will be directed to the main reflector 1 well outside the center hole 3 of the reflector. The focus 11 of the small reflector 2 is preferably placed so in relation to the light center 9 of the bulb, that all light beams from the light center 9 are directed to meet the reflector 1 outside the hole 3. Hereby most of the light intensity from the bulb is used and without heating up the mounting part of the bulb.

In FIG. 2 there is shown a second embodiment of the small reflector 2 and it can be seen that leaf springs 15 of heat resistant material are arranged for fastening the small reflector on the bulb. The position of the small reflector 2 in relation to the main reflector 1 shall be fixed and with this embodiment of the small reflector 2 other means than those described above must be used for fixing the position of the main reflector 1. This means can be of any known type and do not form a part of this invention.

Within the scope of the invention the specific geometric form of the paraboloid may be varied so that the small reflector 2 is adapted to the form of the bulb and to the size of the bulb. However, it is important that the place of the focus of the paraboloid in relation to the light center of the bulb is as described above and just this forms the important part of the invention.

What I claim is:

1. Improvement in reflectors, comprising a first reflector, means for detachably holding a light bulb in said first reflector, said bulb having a spherical top portion and a filament with a center, a small reflector, and means for holding said small reflector onto said light bulb, said small reflector being placed in front of the bulb, and opposite to said first reflector for reflecting direct light beams from the bulb to said first reflector, said first reflector having a centrally arranged hole through which the neck of the bulb is inserted, the edge of said hold being placed on the neck of the bulb said second reflector being placed on the spherical top part of the bulb, whereby said first reflector and said second reflector being positioned in relation to each other and in relation to the center of the filament of the bulb independently of how the bulb is inserted in a socket, wherein said second reflector has a spherical annular form where it abuts the bulb and for the rest has a symmetrical curvature that is parabolically formed, the center of the filament of the bulb being placed outside the focal point of said parabolic curvature, whereby the light beams, which are emitted from the center of the filament of the bulb and are reflected by the concave side of said second reflector towards the bulb, will meet the inner surface of said first reflector outside its center hole.

2. A reflector according to claim 1, wherein said means for holding said small reflector onto said bulb comprises spring leaves gripping said bulb.

3. The reflector of claim 1, wherein said means for holding said small reflector onto said bulb comprises at least two springs interconnecting said small reflector with said first reflector.

* * * * *